US008203060B1

(12) United States Patent
Brewster

(10) Patent No.: US 8,203,060 B1
(45) Date of Patent: Jun. 19, 2012

(54) DEVICE FOR USE WITH CAPO TO KEEP STRINGED MUSICAL INSTRUMENT IN TUNE

(76) Inventor: Jerry J. Brewster, Kemp, TX (US)

( * ) Notice: Subject to any disclaimer, the term of this patent is extended or adjusted under 35 U.S.C. 154(b) by 0 days.

(21) Appl. No.: 12/660,130

(22) Filed: Feb. 22, 2010

(51) Int. Cl.
*G10D 3/00* (2006.01)

(52) U.S. Cl. ..... 84/318

(58) Field of Classification Search ..... 84/318
See application file for complete search history.

(56) References Cited

U.S. PATENT DOCUMENTS 577,930 A * 3/1897 Prince ..... 84/318
3,933,077 A * 1/1976 Dunlop ..... 84/318
4,304,165 A * 12/1981 Gould ..... 84/318
4,412,472 A * 11/1983 Welch ..... 84/318
4,671,156 A * 6/1987 Hathcock ..... 84/318
5,284,077 A * 2/1994 Ellis ..... 84/318
5,373,770 A * 12/1994 Dudley ..... 84/318
6,005,174 A * 12/1999 Regen ..... 84/318
6,958,439 B1 * 10/2005 White ..... 84/318
7,390,948 B2 * 6/2008 Walworth ..... 84/318

* cited by examiner

*Primary Examiner* — Jeffrey Donels
*Assistant Examiner* — Robert W Horn
(74) *Attorney, Agent, or Firm* — Ronnie D. Wilson

(57) ABSTRACT

This invention provides a device for keeping a stringed musical instrument, such as a guitar, in tune while playing same with the use of a capo. The device comprises a bar of lightweight molded plastic material or the like having a bevel on one side and a hook end at the top. The device is positioned whereby the hook end is over the top portion of a guitar neck and the beveled side is under the strings on a fret. The string clamp portion of a capo is placed over the device after it is positioned. The device in place prevents the strings from stretching which would cause the guitar to get out of tune if the device was not in place.

4 Claims, 2 Drawing Sheets

DEVICE FOR USE WITH CAPO TO KEEP STRINGED MUSICAL INSTRUMENT IN TUNE

TECHNICAL FIELD

The present invention relates to stringed musical instruments and more particularly to a device for preventing a fretted stringed instrument such as a guitar, banjo or the like from getting out of tune while being played with a capo.

BACKGROUND OF THE INVENTION

A capo is a device for changing the pitch of the strings of a guitar or the like while being played. The capo is held by the instrument player against the strings at various positions on the neck thereof. As a result of that capo pressing against the strings they are stretched causing them to go sharp and the instrument out of tune.

The prior art discloses no device which prevents the capo from stretching the strings of an instrument and causing it to go out of tune. The present invention solves the problem of string stretching and provides a device that presents an instrument from going out of tune when using a capo.

SUMMARY OF THE INVENTION

It is an objective of the present invention to provide a device for use with a capo to keep a stringed instrument in tune.

It is another objective of the invention to provide a device for use with a capo to prevent the strings of the musical instrument from being stretched by the capo.

It is another objective of the invention to provide a device for keeping a stringed musical instrument in tune in a simple and easy manner.

It is an additional objective of the invention to provide a device for keeping a stringed musical in tune that is inexpensive to manufacture.

It is also an objective of the invention to provide an improved device for keeping a stringed musical instrument in tune that is easy to carry and store.

In accordance with these and other objectives that will become apparent from the detailed description, taken with reference to the figures of the accompanying drawings.

DETAILED DESCRIPTION OF THE DRAWINGS

Figure 1:
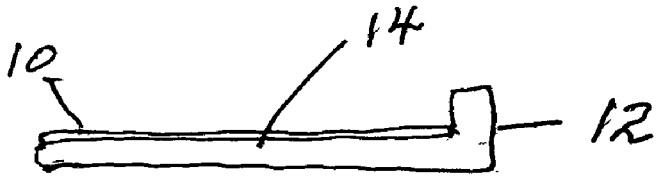
FIG. 1 is a side view of one embodiment of the present invention.

FIG. 1 shows a side view of the present invention. The device 10 is molded nylon in a rectangular shape whereby one end is hook 12 and bevels 14 are in the top portion which allows the device 10 to be positioned under the strings, on top of the fingerboard and over the fret of a stringed musical instrument like a guitar. The device 10 allows the use of a capo without stretching the strings while changing the tuning.

Figure 2:
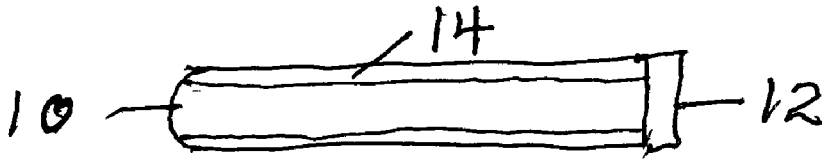
FIG. 2 is a top view of one embodiment of the present invention.

FIG. 2 shows a top view of one of the device 10 having bevel 14 along the edges of the rectangular shape and hook 12 at one end of same.

Figure 3:
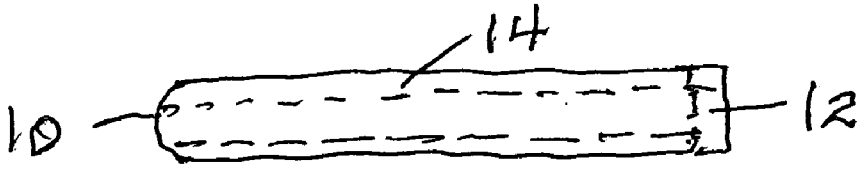
FIG. 3 is a bottom view of one embodiment of the present invention.

FIG. 3 shows a bottom view of the device 10 having a flat surface with bevel 14 on the opposite surface along with hook 12.

Figure 4:
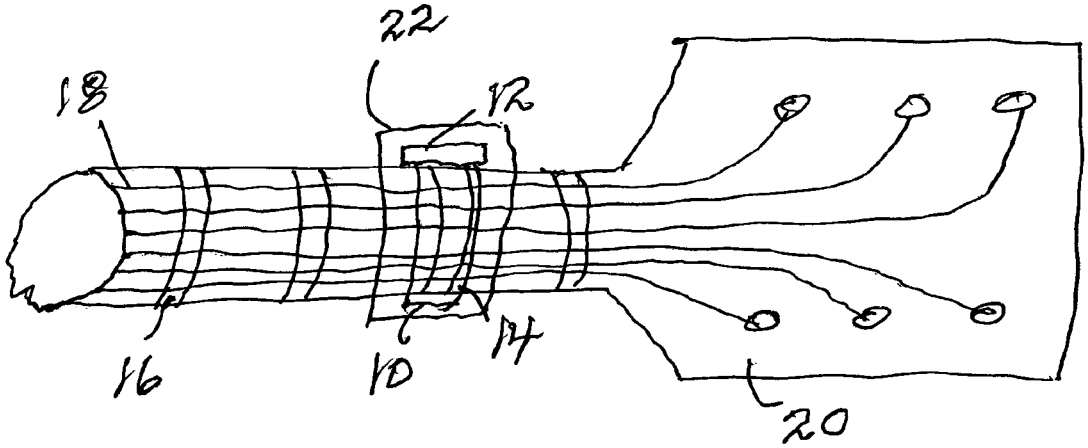
FIG. 4 is a perspective view of a stringed instrument utilizing the present invention with a capo.

FIG. 4 shows a perspective view of a stringed instrument 20 having strings 18, frets 16, and positioned under strings 18 and over fret 14 the beveled side of the device 10 with hook 12 over the top of the fingerboard of instrument 20. While device 10 is in this position, instrument 20 can be played with a capo 22 without stretching the strings and preventing instrument 20 from going out of tune. Instrument 20 can then be played moving to different keys without making the strings go sharp and out of tune via the use of device 10 with a capo 22.

The rigid plastic device 10 can be sized and manufactured to fit any size guitar, banjo, mandolin or the like.

Numerous variations and modifications can be made without departing from the spirit of the present invention. The form of the present invention shown and described herein are illustrative only and are not intended to limit the scope of the present invention.

I claim:

1. A device for use with a capo to keep a stringed musical instrument in tune comprising a unitary body having a flat side and a beveled side and a hook formation at one end wherein said beveled side is positioned under the strings on said musical instrument and over a fret of same and said flat side touches the strings.

2. The device of claim 1 wherein said hook at the top is positioned over the top portion of the neck of said musical instrument.

3. The device of claim 1 wherein it is light weight.

4. The device of claim 1 wherein it is molded rigid plastic.

* * * * *